United States Patent [19]

Shaw et al.

[11] 4,057,442

[45] Nov. 8, 1977

[54] METHOD OF DISPOSAL OF PYROTECHNIC COMPOSITIONS

[75] Inventors: Graham C. Shaw, Garland, Utah; Emil A. Lawton, Sherman Oaks, Calif.; Leon L. Jones, Odgen, Utah

[73] Assignee: Thiokol Corporation, Newtown, Pa.

[21] Appl. No.: 671,478

[22] Filed: Mar. 29, 1976

[51] Int. Cl.[2] ..... C06B 23/00

[52] U.S. Cl. ..... 149/109.4; 149/19.92; 149/42; 149/76

[58] Field of Search ..... 149/109.4, 42, 76, 19.92

[56] References Cited

U.S. PATENT DOCUMENTS 3,333,419 8/1967 Baumgartner et al. ..... 149/109.4 X

*Primary Examiner*—Stephen J. Lechert, Jr.

*Attorney, Agent, or Firm*—Stanley A. Marcus; Royal E. Bright

[57] ABSTRACT

A method for safe, relatively air-pollution free disposal of pyrotechnic compositions is disclosed. High percentage recoveries of the inorganic oxidizer and metallic fuel are achieved, resulting in significant cost benefits, while using a minimum of energy.

19 Claims, No Drawings

METHOD OF DISPOSAL OF PYROTECHNIC COMPOSITIONS

BACKGROUND OF THE INVENTION

This invention pertains to the art of disposing of pyrotechnic compositions, particularly those compositions which comprise a polymerically bound binder containing an inorganic oxidizer, finely divided metal fuel and optionally a burning rate modifier and other specialized additives, which are useable principally in the field of rocket and missile propellants, smoke and gas generators, and illuminants.

The most common past method of disposal of such compositions which were overage, surplus, or otherwise unuseable, was by open pit burning. This method while safe, suffered from the drawbacks that it contributed a great deal of atmospheric pollution, resulted in total destruction of the propellant precluding recovery of any economically valuable or scarce components thereof, and prevented reuse of hardware components associated with the composition.

U.S. Pat. No. 3,451,789 details a process for the recovery of inorganic oxidizers from water insoluble solid propellant matrices. In this process, cured propellant grain is comminuted to fine particle size by milling and then dissolving out the oxidizer by leaching with water. This method requires that the propellant grain be free of any hardware, that energy be used to power whatever mechanical grinding method is employed, and that the metallic fuel particles remain substantially dispersed in the polymeric binder.

The method of the instant invention eliminates the pollution and a large portion of the economic waste associated with open pit burning, allows recovery of the oxidizer, metallic fuel and any associated hardware, does not require prior removal of the pyrotechnic compositions from any hardware to which they may be attached, and does not require the energy expenditure of milling.

SUMMARY OF THE INVENTION

The invention provides a process for the disposal of a solid pyrotechnic composition substantially comprising a solid polymeric binder containing discrete particles of inorganic oxidizer and metallic fuel dispersed therein, and allowing for the recovery of said inorganic oxidizer and metallic fuel, which comprises:

a. disrupting the matrix structure of said polymeric binder by treating said pyrotechnic composition with swelling agents or depolymerizing agents, substantially chemically unreactive with said inorganic oxidizer and said metallic fuel;

b. separating the inorganic oxidizer and metallic fuel from the disrupted polymeric matrix of step a;

c. contacting the inorganic oxidizer and metallic fuel of step b with a fluid selected from water, or a fluid having a density intermediate between that of the inorganic oxidizer and metallic fuel, and being substantially chemically unreactive therewith; and d. separating the mixture of step c.

The process aspect of the invention possesses the inherent applied use characteristic of disposing of pyrotechnic compositions, permitting recovery, if desired, of inorganic oxidizer and metallic fuel dispersed therein, avoiding atmospheric pollution and allowing recovery of hardware associated with the pyrotechnic composition.

A preferred aspect of the process aspect of the invention resides in the concept of a process as set forth for the process aspect of the invention wherein the polymer matrix is disrupted by a depolymerization agent.

Particularly preferred embodiments of this preferred aspect of the process aspect of the invention are:

1. A process as set forth therein wherein the depolymerization agent is a catalytic amount of a Lewis acid or a Lewis base in an organic solvent selected from lower alkanols, di-lower alkyl ethers, or a cyclic hydrocarbon ether containing 4 methylene groups and 1 or 2 oxygen atoms in the heterocyclic ring.

2. A process as set forth therein wherein the fluid contacting the inorganic oxidizer and metallic fuel, after separation from the depolymerized binder, is water.

3. A process as set forth therein wherein the fluid contacting the inorganic oxidizer and the metallic fuel is a fluid intermediate in density to said inorganic oxidizer and said metallic fuel and is substantially chemically unreactive therewith.

Special mention is made of this particularly preferred process wherein the inorganic oxidizer is ammonium perchlorate, the metallic fuel is finely divided aluminum and the fluid is one having a density between 2.0 and 2.6 gm/cc. Particularly preferred is 1,2-dibromoethane.

A second preferred embodiment of the process aspect resides in the concept of a process as set forth for the principal process aspect of the invention wherein the polymer matrix is disrupted with a swelling agent. Particular preferred embodiments of the second preferred embodiment of the process aspect of the invention are:

1. A process as set forth therein wherein the swelling agent contains a Lewis acid catalyst and is a cyclic hydrocarbon ether containing 4 methylene groups and 1 or 2 oxygen atoms in the heterocyclic ring, or a di-lower alkyl formamide.

2. A process as set forth therein where the oxidizer and metallic fuel solids are separated from the swollen binder by washing and filtration through a screen with mesh large enough to pass said oxidizer and fuel particles but small enough to retain the swollen binder.

Special mention is made of these preferred aspects wherein the inorganic oxidizer is ammonium perchlorate, the swelling agent is either dimethyl formamide, or tetrahydrofuran, the Lewis acid catalyst is aluminum chloride, and the metallic fuel is aluminum powder.

DESCRIPTION OF THE PREFERRED EMBODIMENT

The particular method chosen for the disruption of the polymeric matrix of a particular pyrotechnic composition will, of course, be somewhat dependent on the nature of the composition, particularly the chemical nature of the polymeric matrix.

The binders chosen for pyrotechnic compositions are almost universally chosen for their ability to provide a mechanically strong grain that is stable to normal atmospheric conditions, for example; resistance to hydrolysis at high humidity, and to oxidation by oxygen or particularly ozone.

Typical binder types for the pyrotechnic compositions to which the process of this invention is applicable include for example; polyurethanes, polyesters, polyethers, polybutadienes, and polysulfide rubbers, either as single entities, or mixtures, or as copolymers either straight or branched chain, cross-linked or uncross-linked.

Breakdown of the matrices formed by the polymer binder can be accomplished by chemical attack on the polymeric linkage or by solvent swelling. For example, a carboxyl-terminated polymer cross-linked with a phosphine oxide may be hydrolyzed by treating it with water, polyurethanes may be degraded by acid or base catalysis, and polyesters may be transesterified with a low molecular weight alcohol either using base or acid catalysis. Where chemical attack is not possible a suitable swelling agent, such as, for example, tetrahydrofuran, dimethyl formamide, aromatic hydrocarbons such as benzene or toluene, aromatic amines such as pyridine, chlorinated hydrocarbons such as chloroform, or ethylene dichloride, hydrocarbons such as kerosene, petroleum ether, hexane and cyclohexane and the like, either in the presence or absence of Lewis acid or base catalysis will cause the polymeric matrix to swell allowing solid components enclosed therein to be flushed out.

The skilled chemist will be able to select the particular combination of solvent and, if necessary, catalyst or swelling agent for each application. They will be such that no substantial reaction will occur with either the inorganic oxidizer or the metal fuel. Similarly if the polymer is rendered soluble the selection of a solvent system in which the inorganic oxidizer is substantially insoluble is readily done by one skilled in the art. One skilled in the art will also recognize that frequently, particularly where swelling is employed, the binder will be recovered in a form suitable for reprocessing. This may also be true where chemical attack on the polymeric structure has not substantially altered the basic chemical type of the subpolymeric units generated by the reaction. It will also be apparent to one skilled in the art that other chemical methods may be suitable for particular polymers not amendable to the degradation methods previously set forth, for example; polybutadienes may first be subjected to oxidization of the double bond and then subjected to a solvolytic reaction. The separation of the inorganic oxidizer and metal fuel from the disrupted polymeric matrix may be accomplished by standard techniques. The selection of a particular technique will, of course, depend upon the method employed to disrupt the matrix. For example, if the polymer has been rendered soluble it is convenient to dissolve it in a solvent in which the inorganic oxidizer and metallic fuel will be substantially in solid form and be separable by filtration, and if the disrupted matrix is insoluble flotation techniques may be conveniently employed to effect the desired separation. The separation of the inorganic oxidizer from the metallic fuel is accomplished by dissolving the inorganic oxidizer, which will be a soluble salt, normally ammonium perchlorate, or sodium nitrate or a close congener thereof, in water and separating from the metal fuel by simple filtration. A fluid of density intermediate between that of the inorganic oxidizer and the particular metal fuel, and which will not react with either may also be used for the separation. The recovery of the oxidizer and the metallic fuel from either of these techniques may be accomplished by standard methods such as centrifugation, or filtration and drying. If the oxidizer is in solution it may be concentrated to cause crystallization of the solute, which may then be recovered, or the solution may be introduced into the process of manufacture of new oxidizer. One skilled in the art will also recognize that frequently the metallic fuel will be recovered in a form where the particle size and lack of attack on the surface by the reagents employed will permit reuse directly in new pyrotechnic compositions, but that even if such direct use is not possible the reprocessing of this recovered fuel material can be done at a fraction of the energy cost of reduction of new metal.

The exact times and temperatures of the processes for the disruption of the polymeric matrix and the dissolution, where desired, of the inorganic oxidizer are, of course, not critical, depending principally on the size of the propellant grain and its available surface area, and one skilled in the art would readily be able to determine the minimum contact time and temperature required for adequate disruption of the matrix and obviously for dissolution of the oxidizer. It will also be obvious that if one wishes to reduce the time required for the disruption of large masses of propellant grain, it may be subdivided into smaller portions or separated from attached hardware by any convenient means at hand, so as to allow disruption to initially be commenced with access to a larger surface area.

The selection of a particular acid or base catalyst or oxidizer for the disruption of a particular polymer is also within the skill of the art. Lewis acids or bases and organic oxidizers are preferred. Aluminum chloride is a convenient Lewis acid, and trimethyl amine is a convenient Lewis base.

As used herein, and in the appended claims, the term lower alkyl means a saturated hydrocarbon radical, including the straight and branched radicals, having from bout one to about 8 carbon atoms, among which are, for the purposes of illustration, but without limiting the generality of the foregoing, methyl, ethyl, n-propyl, n-butyl, i-butyl and the like. The term lower alkanol means a lower alkyl radical, as defined herein above, having from 1 to about 6 carbon atoms, which is monosubstituted by a hydroxyl moiety, among which are for the purposes of illustration, but without limiting the generality of the foregoing, methanol, ethanol, i-propanol and the like. The term metallic fuel means the common metal powders used as fuel in pyrotechnic compositions, such as, aluminum, magnesium and the like.

The following examples further illustrate the best mode contemplated by the inventors for the practice of their invention.

EXAMPLE 1

A flare composition consisting of an epoxy cross-linked polyester (obtained from a triepoxide derived from the condensation of p-aminophenol with epichlorohydrin and a polyester obtained from the condensation of succinic acid and triethylene glycol), containing sodium nitrate as oxidizer and magnesium as metal fuel is added to methanol containing aluminum chloride from about 0.5 to about 5% by weight of the polymeric binder, and the mixture allowed to stand for about 8 to about 20 hours. If desired the mixture may be stirred so as to reduce the time required for solution of the binder. When the binder has gone into solution, the mixture is separated and the solid residue washed with excess methanol. Treatment of the washed residue with water gives a solution of the inorganic oxidizer in a form suitable, after separtion, for recrystllization and the powdered metal fuel is retained as a residue ready for recycling.

EXAMPLE 2

An 88% solids high energy propellant containing a binder consisting of an isophoronediisocyanate-cured hydroxyl terminated polybutadiene is treated with about 1 to about 15 weight percent of aluminum chloride and tetrahydrofuran. The solution is either refluxed for about 4 hours or allowed to stand for an extended period, conveniently about 18 to 40 hours. Once the binder has dissolved, the resulting mixture is filtered, washed with fresh tetrahydrofuran and dried. The recovery of mixed aluminum fuel and ammonium perchlorate is quantitative. Treatment with water gives a solution of ammonium perchlorate which after separation from the undissolved aluminum is suitable for recrystallization. The aluminum powder is in form suitable for recycling.

EXAMPLE 3

The procedure of Example 2 is followed substituting treatment of the dried ammonium perchlorate, aluminum powder residue with 1,2-dibromoethane for the treatment with water. The ammonium perchlorate is recovered from the upper surface as a powder, and the aluminum is recovered from the lower surface of the system.

EXAMPLE 4

A propellent containing 14% nitrate ester plasticizer (of a type similar to nitroglycerin), 4% urethane polyester binder (containing triethylene glycol succinic acid condensation polyester cured with hexanethylene diisocyanate), 18% aluminum fuel, 10% ammonium perchlorate and 54% cyclotrimethylene trinitramine (HMX) was added to dimethyl formamide and stirred while warming to increase the rate and extent of solvent absorbed by the binder. When swollen, the binder released the ammonium perchlorate, aluminum, and some HMX. The remainder of the HMX dissolved in the solvent. The aluminum and oxidizer solids were easily separable from the binder by filtration through a coarse screen followed by washing with additional solvent. HMX dissolved in the solvent was recoverable by evaporation and crystallization following standard techniques. The separate recovery of the solid aluminum, ammonium perchlorate and HMX is easily accomplished by the technique of Examples 1 thru 3.

EXAMPLE 5

A procedure analogous to that of Example 4 was followed in recovering aluminum, ammonium perchlorate and HMX from a propellant composition similar to the one described therein but substituting dimethyl formamide for tetrahydrofuran.

EXAMPLE 6

Procedures analogous to that of Examples 4 and 5 were followed in recovering aluminum, ammonium perchlorate and HMX from propellant compositions similar to those described therein, but between 1 and 5% anhydrous aluminum chloride is added to the swelling agent.

The subject matter which applicants regard as their invention is particularly pointed out and claimed as follows:

1. A process for the disposal of a solid pyrotechnic composition substantially comprising a solid polymeric binder containing discrete particles of inorganic oxidizer and metallic fuel dispersed therein; and allowing for the recovery of said inorganic oxidizer and metallic fuel which comprises:

a. disrupting the matrix structure of said polymeric binder by treating said pyrotechnic composition with a swelling agent, or depolymerizing agent, substantially chemically unreactive with said inorganic oxidizer and said metallic fuel;

b. separating the inorganic oxidizer and metallic fuel from the disrupted polymeric matrix of step a;

c. contacting the inorganic oxidizer and metallic fuel from step b with a fluid selected from water, or a fluid having a density intermediate to that of the inorganic oxidizer and metallic fuel, and being substantially chemically unreactive therewith, to form a mixture which comprises, a solution of inorganic oxidizer and solid metallic fuel, or a layer of solid metallic fuel, a layer of said fluid of intermediate density and a layer of solid inorganic oxidizer; and d. separating said mixture of step c.

2. A process as defined in claim 1 wherein the polymeric matrix is disrupted by a depolymerizing agent.

3. A process as defined in claim 2 wherein the fluid contacting the inorganic oxidizer and metallic fuel after separation from the depolymerized binder is water.

4. A process as defined in claim 3 wherein the depolymerizing agent comprises a lower alkanol.

5. A process as defined in claim 4 wherein the Lewis acid is aluminum chloride.

6. A process as defined in claim 4 wherein the Lewis base is trimethylamine.

7. A process as defined in claim 3 wherein the inorganic solvent is a cyclic hydrocarbon ether containing four methylene groups and one or two oxygen atoms in the heterocyclic ring.

8. A process as defined in claim 7 wherein the Lewis acid is aluminum chloride.

9. A process as defined in claim 3 wherein the inorganic oxidizer is ammonium perchlorate, and the metallic solids are finely divided aluminum.

10. The process of claim 9 wherein the inorganic oxidizer and metallic solids after being separated from the polymeric matrix are treated with an inert fluid having a density between 2.0 and 2.6 grams per cc.

11. The process as defined in claim 10 wherein the inert fluid is 1,2-dibromoethane.

12. A process as defined in claim 3 wherein the inorganic oxidizer is ammonium perchlorate, and the metallic solids are finely divided magnesium.

13. A process as defined in claim 12 wherein the depolymerizing agent comprises a lower alkanol.

14. A process as defined in claim 12 wherein the Lewis acid is aluminum chloride.

15. A process as defined in claim 1 wherein the polymeric matrix is disrupted with a swelling agent.

16. A process as defined in claim 15 wherein the swelling agent comprises tetrahydrofuran.

17. A process as defined in claim 16 wherein the swelling agent additionally comprises aluminum chloride.

18. A process as defined in claim 15 wherein the swelling agent comprises dimethyl formamide.

19. A process as defined in claim 18 wherein the swelling agent additionally comprises aluminum chloride.

* * * * *